US008607391B2

(12) United States Patent
Poppe

(10) Patent No.: US 8,607,391 B2
(45) Date of Patent: Dec. 17, 2013

(54) PILLOW OR MATTRESS WITH CLOSED COMFORT LAYER HAVING OPENINGS

(76) Inventor: Willy Poppe, Sint-Niklaas (BE)

( * ) Notice: Subject to any disclaimer, the term of this patent is extended or adjusted under 35 U.S.C. 154(b) by 410 days.

(21) Appl. No.: 11/988,036

(22) PCT Filed: Jun. 28, 2006

(86) PCT No.: PCT/BE2006/000074
§ 371 (c)(1),
(2), (4) Date: Dec. 28, 2007

(87) PCT Pub. No.: WO2007/003018
PCT Pub. Date: Jan. 11, 2007

(65) Prior Publication Data
US 2008/0271250 A1 Nov. 6, 2008

(30) Foreign Application Priority Data
Jun. 30, 2005 (BE) ..... 2005/0334

(51) Int. Cl.
*A47C 17/00* (2006.01)

(52) U.S. Cl.
USPC ..... 5/740; 5/636; 5/737; 5/655.9; 5/724; 5/953; 5/719

(58) Field of Classification Search
USPC ..... 5/636, 737, 740, 655.9, 724, 953, 719, 5/490, 500, 502; 428/131
See application file for complete search history.

(56) References Cited

U.S. PATENT DOCUMENTS

| | | | | |
|---|---|---|---|---|
| 3,381,999 | A | 5/1968 | Steere, Jr. | |
| 4,194,255 | A * | 3/1980 | Poppe | 267/153 |
| 5,121,515 | A * | 6/1992 | Hudson | 5/636 |
| 5,325,552 | A | 7/1994 | Fong | |
| 2003/0097715 | A1 | 5/2003 | Barman | |

FOREIGN PATENT DOCUMENTS

| | | |
|---|---|---|
| DE | 85 17 516 U1 | 8/1985 |
| DE | 41 42 837 A1 | 12/1992 |
| FR | 1 263 758 A | 6/1961 |
| GB | 1 033 643 A | 6/1966 |
| GB | 1 036 387 A | 7/1966 |
| GB | 2 176 397 A | 12/1985 |

* cited by examiner

*Primary Examiner* — Robert G Santos
*Assistant Examiner* — David E Sosnowski
(74) *Attorney, Agent, or Firm* — McKenna Long & Aldridge LLP

(57) ABSTRACT

Pillow or mattress having a comfort layer (5) which is made of natural or synthetic latex, polyurethane foam or another elastic material. The comfort layer 5 is provided with interrupted incisions (6) through the layer 5, along mainly parallel lines 7, and the layer (5) forms at least a part of a jacket around a core (2) of the pillow or mattress that is stretched in a lateral direction (P) which is mainly transverse to the direction of the above-mentioned lines (7) in order to open the incisions (6) so as to form passages (8) through the comfort layer (5).

18 Claims, 2 Drawing Sheets

PILLOW OR MATTRESS WITH CLOSED COMFORT LAYER HAVING OPENINGS

FIELD OF THE INVENTION

The present invention concerns an improved pillow, mattress or other similar object.

In particular, the invention concerns a pillow or other similar object, whereby a core is formed of springs and whereby a comfort layer is provided around the core for a better feeling for the user and to fit better around the body contours of said user.

Said comfort layer is usually provided with an outer lining textile.

BACKGROUND

Different types of comfort layers are already known, such as different layers of polyester fibres that are processed into a comfort layer via carding and that are stuck together by means of melting the fibres.

These known comfort layers feel very nice and are still frequently used to cover pillows, mattresses or other similar objects.

However, a disadvantage of such known comfort layers is that they quickly lose their resilience, as the fibres are repeatedly compressed and when the known comfort layers lack the resilience to reassume their original shape, the product concerned becomes less comfortable and even unfit for use.

Comfort layers that are made of a natural or synthetic latex are also known.

While these known comfort layers do not quickly become compressed and lose their shape, such known comfort layers are disadvantageous in that natural or synthetic latex has a closed cell structure, such that, when such a comfort layer is used on a mattress for example, damp air and sweat cannot be absorbed by the mattress.

A disadvantage linked thereto is that the user will perspire even more, since there is no ventilation, and any feeling of comfort is lost.

The most recent known comfort layer is made of viscoelastic polyurethane foam.

This type of soft foam has properties that are subject to change caused by variations in temperature and behaves like a sort of thermoplastic, such that comfort layers formed of such viscoelastic polyurethane foam become softer as a result of the influence of body temperature and thus "rolls" itself around the body or the head.

A major disadvantage of this material is the large number of closed cells that are present in the foam structure, so that here as well, the necessary ventilation is largely lacking, and the head or body gradually becomes warm or overheated, and perspiration cannot be properly vented.

SUMMARY

The present invention aims to remedy one or several of the above-mentioned and other disadvantages and to provide a pillow, mattress or other similar object that provides an increased feeling of comfort during use.

To this end, the invention concerns an improved pillow, mattress or other similar object having a comfort layer which is provided around a core of the pillow or other object and which is made of natural or synthetic latex, polyurethane foam or another elastic material, whereby interrupted incisions are provided through the inventive comfort layer along mainly parallel lines, and in the comfort layer forms at least a part of a jacket around the core that is stretched in a lateral direction which is mainly transverse to the direction of the above-mentioned lines in order to open the incisions so as to form passages through the comfort layer.

By cutting into the elastic material of the comfort layer and by further stretching it open, passages are created which offer the advantage that such an improved comfort layer becomes entirely air permeable and thus offers the possibility to remove all perspiration and damp air through the openings and to provide for improved air circulation.

Another advantage is that the comfort layer can be made extremely soft when said incisions are stretched open, which is not always feasible with a solid comfort layer.

Thus, for example, no existing durable, compact comfort layer is soft enough to be used as a cover layer of a pillow.

Moreover, the proposed improved comfort layer can be produced in a very economical manner, since by providing incisions and by stretching open the comfort layer, an average surface gain of approximately 75% is obtained, while the thickness of the comfort layer is only reduced by a few percent.

Moreover, no waste whatsoever is produced during the manufacture of the comfort layer, which is economically sound, since latex and especially viscoelastic polyurethane foam are very expensive materials.

The incisions may vary in length and mutual distances as a function of the thickness of the comfort layer, such that preferred rhombic openings can be made for any possible application and desired softness.

This makes it possible to produce the improved comfort layer in an automated manner and to easily control the quality of the comfort layer.

The improved comfort layer is preferably made of a viscoelastic polyurethane foam which, as already mentioned above, is temperature-sensitive and assumes the shape of the body under the influence of the body heat and pressure, and after use always reassumes its original shape.

By stretching the improved comfort layer to a greater or lesser extent in certain zones compared to other zones, comfort zones can be created having different localized properties depending on the wishes of the user.

Different comfort zones can also be created by using larger or wider incisions in certain zones or by using zones with and without incisions. Thus, for example, zones with different degrees of softness or with different supporting effects for the body can be created. In this way the edges of the pillow, mattress or other similar object can be made more firm.

The comfort layer forming the jacket is preferably caused to be stretched due to the lateral dimension thereof in unstretched position being smaller than the circumference of the core of the pillow or other similar object.

This way there is no need for a supporting frame or a supporting layer on which the comfort layer is to be glued or attached in order to maintain the comfort layer in a stretched position.

A pillow or other similar object can thus be created in a very easy manner by gluing the opposite sides of the comfort layer together in order to form a cylindrical jacket or pouch wherein, with respect to the dimensions of this jacket, an oversized core is introduced that maintains the comfort layer stretched in at least a lateral direction perpendicular to the direction of the incisions.

BRIEF DESCRIPTION OF THE DRAWINGS

In order to better explain the characteristics of the present invention, the following preferred applications of an improved comfort layer according to the invention are given as an example only without being limitative in any way, with reference to the accompanying drawings, in which.

DETAILED DESCRIPTION

Figure 1:
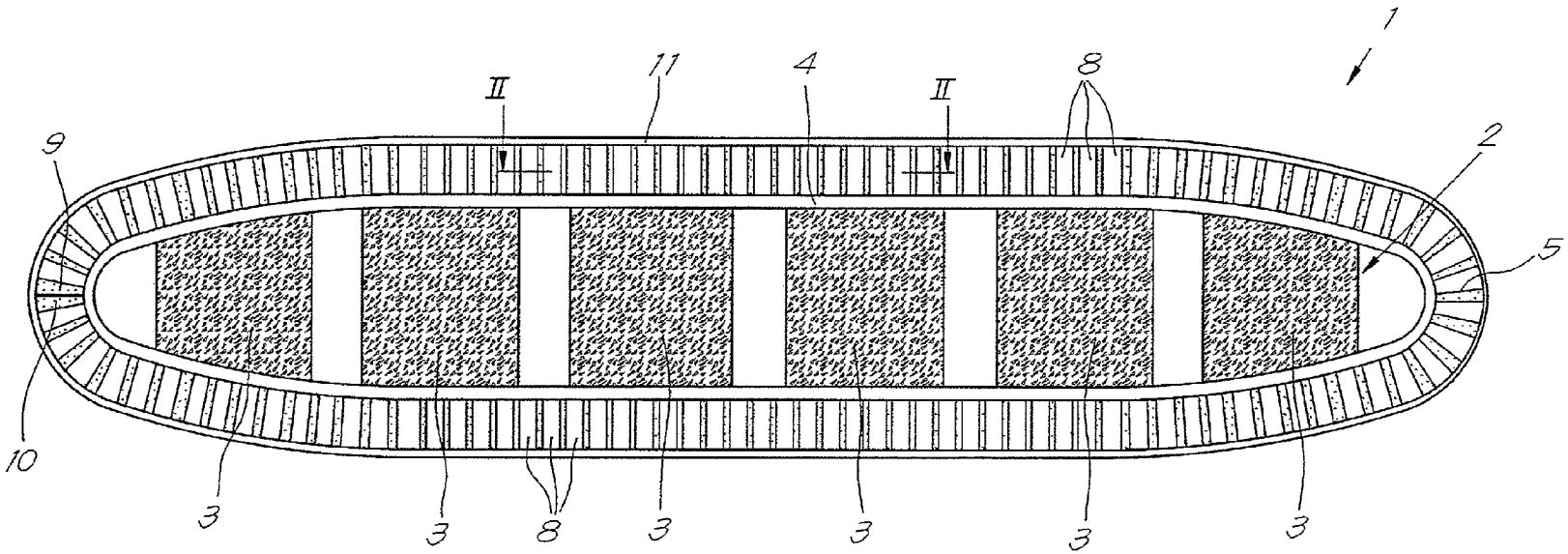
FIG. 1 schematically represents a section of an improved pillow according to the invention.

The improved pillow 1 represented in FIG. 1 consists of a core 2 of cylindrical foam springs 3 made of polyurethane glued onto a piece of "non-woven" material 4.

Figure 3:
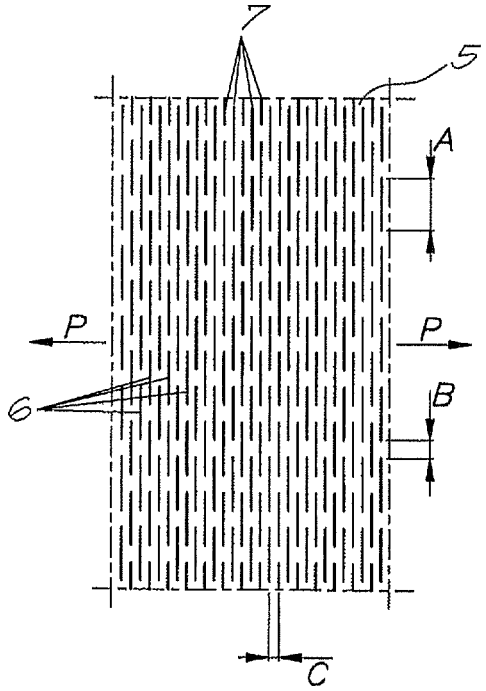
FIG. 3 represents a view similar to FIG. 2, but for an unstretched condition.

The core 2 is provided within a jacket made of a comfort layer 5 which, in the case of the invention, is formed of a layer of polyurethane foam or latex or preferably a viscoelastic foam in which, before the comfort layer 5 is used, interrupted incisions 6 through the thickness of comfort layer 5 are provided along mainly parallel lines 7 as is represented in FIG. 3.

The incisions 6 are preferably provided according to a regular pattern and in particular according to a staggered pattern as shown in FIG. 3.

Figure 2:
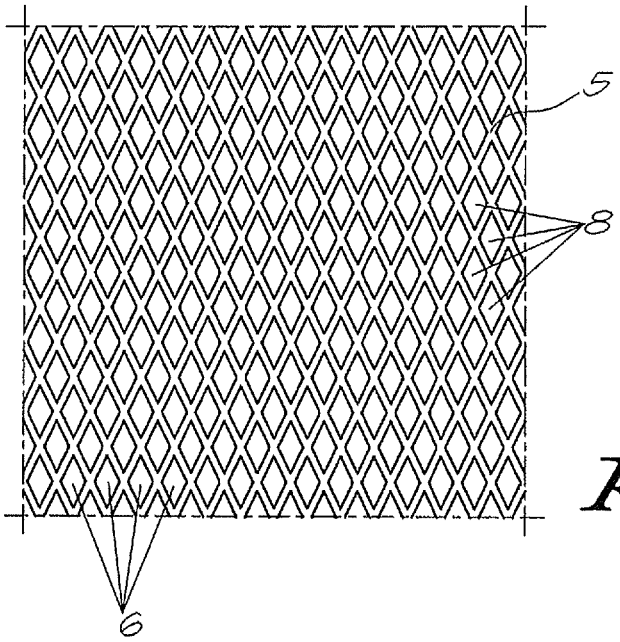
FIG. 2 represents a section according to line II-II in FIG. 1.

When the comfort layer 5 with the incisions 6 is provided around the core 2, the comfort layer 5 is stretched according to the invention in a lateral direction according to the arrows P indicated in FIG. 3, which is mainly transverse to the direction of the above-mentioned lines 7, as a result of which the incisions 6 are stretched open so as to form passages 8 through the comfort layer 5, as represented in FIG. 2.

In order to stretch the comfort layer 5, both opposite sides 9 and 10 of the comfort layer 5 are connected to each other by gluing or other suitable process or mechanism, such that a cylindrical jacket or shell or pouch is created. The comfort layer 5 can then be stretched, such that the core 2 can be slid into the interior of the jacket or shell or pouch. Next, the open sides of the cylindrical shell are closed by gluing or other suitable process or mechanism, such that the comfort layer 5 forms an entirely closed jacket or pouch around the core 2.

The pillow 1 is further finished with an outer sleeve 11 made of fabric.

As an alternative, the improved comfort layer 5 can be provided beforehand on one or both sides with a supporting layer in the form of a "non-woven" fabric. The supporting layer is then also provided with incisions and the supporting layer provides a larger tear strength and tensile strength to the comfort layer 5.

Good results are obtained with regard to lay and seating comfort when the length A of the incisions 6 is larger than the mutual distances B between incisions 6 that are formed along a straight line, such that, when stretching the comfort layer 5, rhombic or diamond-shaped passages 8 are obtained.

The length A of the incisions 6 preferably amounts to approximately double the distance B between the incisions 6 that are formed along a straight line, and the distance C between the parallel lines 7 along which the incisions 6 are provided, is smaller than the distance B between the incisions 6 that are formed along a straight line.

It is clear that the softness of the comfort layer 5 can be adjusted to the wishes of the user by stretching the comfort layer 5 to a larger or smaller extent.

This also makes it possible to adjust the comfort in certain zones of the pillow 1 or other similar object, by locally stretching the comfort layer 5 more or less in certain specified zones than in other zones.

The qualities of the comfort layer 5 can also be adjusted to the wishes of the user by varying the thickness of the comfort layer 5, the hardness of the selected foam, or the geometrical data of the incisions 6 and of the passages 8.

The incisions 6 must not necessarily be provided according to straight lines; they may also be formed as angular or bent incisions or incisions in any other shape whatsoever or along curved lines.

If necessary, the improved comfort layer 5 may consist of different parts having different patterns of incisions 6, in order to make the comfort layer 5 harder or softer in certain zones, i.e. harder at the edges of the pillow 1.

The improved comfort layer 5 may also be formed of different strips of material with varying degrees of hardness, so that in this manner as well, different comfort zones are created.

It is clear that the core 2 does not necessarily need to be made of springs, but that also other resilient materials can also be used to fill the core 2.

It is also clear that the jacket does not have to be entirely made of an incised comfort layer, but that for instance only that part of the jacket that is used to support a body part of a user may be made of such a layer and that this comfort layer is stretched by pulling the opposite sides 9 and 10 together with a string or a piece of cloth which is attached to both sides 9 and 10.

The present invention is by no means limited to the embodiment described above and represented in the accompanying drawings; on the contrary, such a pillow can be made according to different variants while still remaining within the scope of the invention.

The invention claimed is:

1. A pillow or mattress, comprising:

a core including a plurality of springs, each of the springs having a top side and a bottom side;

a jacket enclosing the core, the jacket comprising a comfort layer comprised of an elastic material having a plurality of apertures extending from an outer surface of the jacket to an inner surface of the jacket, the apertures being of variable width depending on an amount of stretching of the elastic material; and the apertures being formed by a plurality of incisions extending along generally parallel lines in the elastic material, wherein the length of the incisions amounts to about the double of the distance between the incisions in a given parallel line; and wherein the distance between the parallel lines along which the incisions are provided is smaller than the distance between the incisions that are in line; and wherein the comfort layer further includes at least a first region and a second region, at least one of the springs positioned within the jacket between opposing inner surfaces of the first region and the second region, the top side of the spring opposing the first region and the bottom side of the spring opposing the second region.

2. A pillow or mattress according to claim 1, wherein the jacket is formed by connecting at least two opposite sides of the comfort layer.

3. A pillow or mattress according to claim 2, wherein the opposite sides of the comfort layer are connected together by an adhesive layer.

4. A pillow or mattress according to claim 1, wherein the comfort layer is made of a viscoelastic foam.

5. A pillow or mattress according to claim 1, wherein the incisions are arranged according to a staggered pattern.

6. A pillow or mattress according to claim 1, wherein the comfort layer is stretched more or less in certain zones.

7. A pillow or mattress according to claim 1, further comprising a fabric outer sleeve surrounding the jacket.

8. A pillow or mattress according to claim 1, further comprising a non-woven fabric supporting layer provided on one or both sides of the comfort layer wherein the supporting layer is also provided with incisions.

9. A pillow or mattress according to claim 1, wherein the incisions are arranged in a first regular pattern in a first zone, and in a second regular pattern in a second zone, wherein the first regular pattern is different from the second regular pattern.

10. A pillow or mattress according to claim 1, wherein the comfort layer comprises different strips of material having different degrees of hardness.

11. A pillow or mattress according to claim 1, wherein different comfort zones are created in the comfort layer by using incisions with varying lengths in different zones.

12. A pillow or mattress according to claim 1, wherein different comfort zones are created in the comfort layer by using zones with incisions and zones without incisions.

13. A pillow or mattress according to claim 1, wherein the jacket is completely closed.

14. A pillow or mattress according to claim 13, wherein the closed jacket has an oblong shape having a substantially larger width than thickness, where during use of the pillow or mattress a load is applied perpendicularly to the width of the jacket.

15. A pillow or mattress according to claim 1, wherein the jacket is formed by connecting at least two opposite sides of the comfort layer, so that the comfort layer is a unitary comfort layer.

16. A pillow or mattress according to claim 1, wherein the elastic layer is constructed from a material selected from a group consisting of natural latex, synthetic latex and polyurethane foam.

17. A pillow or mattress, comprising:

a core;

a jacket enclosing the core, the jacket including a stretchable comfort layer having first and second opposed sides on opposite sides of the core, the comfort layer including:

in an unstretched state, a plurality of generally linear incisions extending from an outer surface of the jacket to an inner surface of the jacket; and wherein in a stretched state, the plurality of generally linear incisions becomes a plurality of apertures extending from the outer surface of the jacket to the inner surface of the jacket, the apertures being of variable area depending on an amount of stretching of the comfort layer; and wherein the length of the incisions amounts to about the double of the distance between the incisions in a given parallel line; and wherein the distance between the parallel lines along which the incisions are provided is smaller than the distance between the incisions that are in line.

18. A pillow or mattress according to claim 17, wherein an average surface gain of 75% is obtained by the stretched comfort layer.

* * * * *